United States Patent [19]

Ward, Jr.

[11] Patent Number: 4,958,829

[45] Date of Patent: Sep. 25, 1990

[54] ADJUSTABLE FEED ROLLS FOR FEEDING SHEETS

[75] Inventor: William F. Ward, Jr., Hampstead, Md.

[73] Assignee: The Ward Machinery Company, Cockeysville, Md.

[21] Appl. No.: 305,808

[22] Filed: Feb. 1, 1989

[51] Int. Cl.[5] ..... B65H 5/06

[52] U.S. Cl. ..... 271/273; 226/177

[58] Field of Search ..... 271/272, 273, 274; 226/176, 177

[56] References Cited

U.S. PATENT DOCUMENTS

| | | | |
|---|---|---|---|
| 1,193,382 | 8/1916 | Hayes | 271/273 |
| 3,326,439 | 6/1967 | Sarka | 271/274 X |
| 4,048,831 | 9/1977 | Fabian | 226/177 X |
| 4,158,429 | 6/1979 | Ohmori | 226/177 X |

*Primary Examiner*—Richard A. Schacher

*Attorney, Agent, or Firm*—Boyce C. Dent; Edward D. C. Bartlett

[57] ABSTRACT

Apparatus, for example for processing sheets of corrugated paperboard in the production of container blanks, has a pair of feed rolls between which the sheets are fed while passing through the apparatus, and a pair of side frames in which the feed rolls are rotatably mounted one above the other. The upper of the feed rolls is journalled in bearings mounted eccentrically in bearing housings rotatable in holes in the side frames. Gearing is provided for adjustably rotating the bearing housings in the holes to move the upper feed roll respectively away from and towards the lower of the feed rolls. A pair of wedges act upon each bearing housing and are disposed in a cavity in each side frame below and communicating with the respective bearing housing. The wedges are moved towards each other by a screw bolt and/or a fluid cylinder to pre-load the bearing housings upwards in their holes. This takes up tolerances and eliminates hammering of the eccentric bearing housings in the side frame holes as successive sheets enter between the feed rolls.

16 Claims, 5 Drawing Sheets

ADJUSTABLE FEED ROLLS FOR FEEDING SHEETS

FIELD OF THE INVENTION

This invention relates to feed rolls for feeding sheets of material therebetween, and in which the feed rolls are adjustable relative to each other for moving the feed rolls away from and towards each other, respectively.

BACKGROUND OF THE INVENTION

With feed or nip rolls for feeding sheets, particularly sheets of corrugated paperboard, it is known to have adjusting means for moving one of the feed rolls away from and towards the other, respectively, to set the nip between the feed rolls for runs of different thickness sheets. Such adjusting means may include eccentric bearing housings for the upper feed roll which can be rotated to displace the upper feed roll relative to the lower feed roll.

SUMMARY OF THE INVENTION

I have realized that with the foregoing arrangement, due to tolerances between the eccentric bearing housings and holes in side frames in which they rotate, the eccentric bearing housings tend to "hammer" in these holes as successive sheets enter between the feed rolls. This in turn causes wear and deterioration of the eccentric bearing housings and/or the side frame holes.

It is an object of the present invention to solve, or at least mitigate, this problem.

A feature by which this object is achieved is preloading the bearing housings of the adjustable feed roll away from the other feed roll. This has the advantage of taking up tolerances between the eccentric bearing housings and the side frame holes away from the other roll so eliminating, or at least reducing, the "hammering".

Accordingly, therefore, there is provided by one aspect of the invention an apparatus comprising a pair of rotatable nip rolls, one of the rolls being eccentrically mounted in rotatably adjustable bearing housings, adjustable rotation of the bearing housings moving that one roll towards or away from the other roll, and means for pre-loading the bearing housings in a direction away from the other roll.

Preferably, the pre-loading means comprises wedges acting upon the bearing housings. The wedges may have concavely curved surfaces.

Advantageously, the wedges may be located in cavities in side frames supporting the rolls.

According to another aspect of the invention, there is provided an apparatus for processing sheets of corrugated paperboard in the production of container blanks, comprising a pair of feed rolls between which the sheets are fed while passing through the apparatus, a pair of side frames in which the feed rolls are rotatably mounted one above the other, the upper of the feed rolls being journalled in bearings which are mounted eccentrically in bearing housings rotatable in holes in the side frames. Means is provided for adjustably rotating the bearing housings in the holes to move the upper feed roll respectively away from and towards the lower of the feed roll. A cavity is disposed in each side frame below and communicating with the respective bearing housing, a pair of wedges being disposed in each cavity and acting upon the respective bearing housing. Means is provided for moving the pair of wedges towards each other to force the respective bearing housing upwards in the respective side frame hole.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters designate similar parts.

DETAILED DESCRIPTION OF THE PREFERRED EMBODIMENTS

Figure 2:
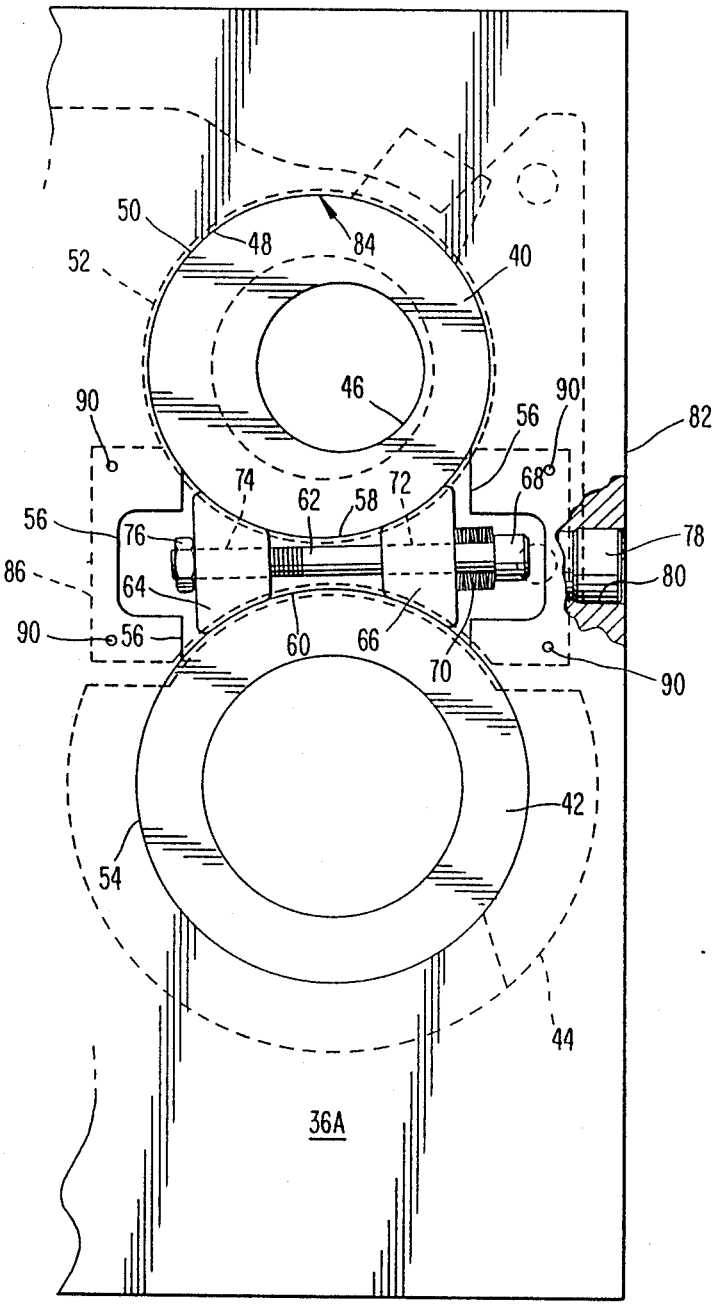
FIG. 2 is an elevational view of the inside of a portion of one of the side frames of part of the sheet feeding apparatus of FIG. 1 modified in accordance with the present invention, shafts, bearings and other parts being omitted for clarity and a fragment of the side frame being shown in section.
Figure 4:
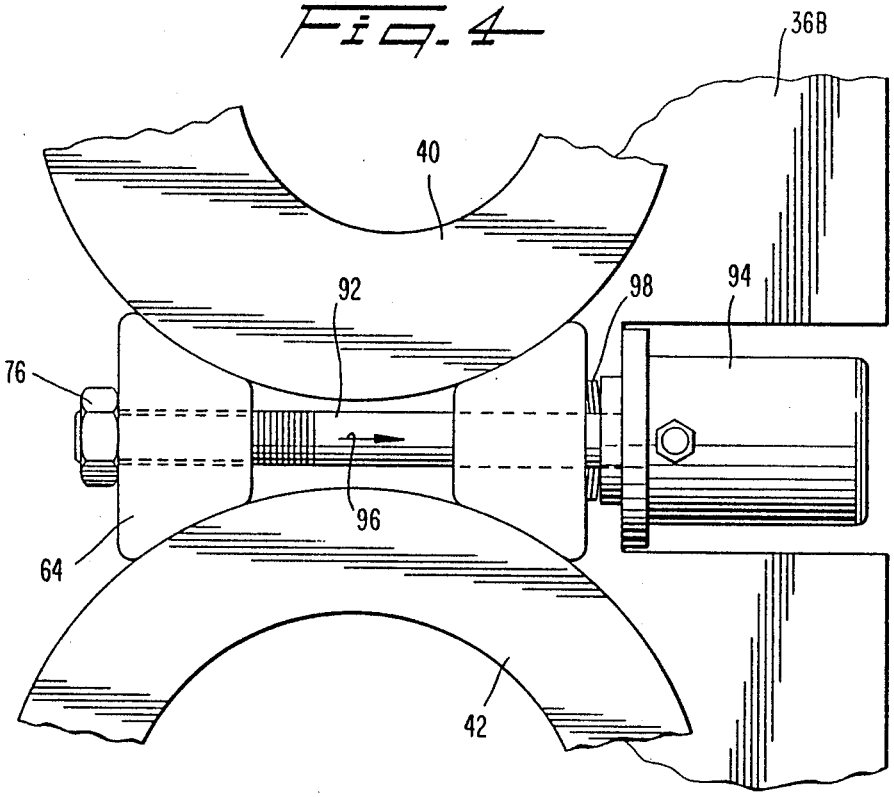
FIG. 4 is a view similar to a portion of FIG. 2, but modified to illustrate a second embodiment of the invention.
Figure 5:
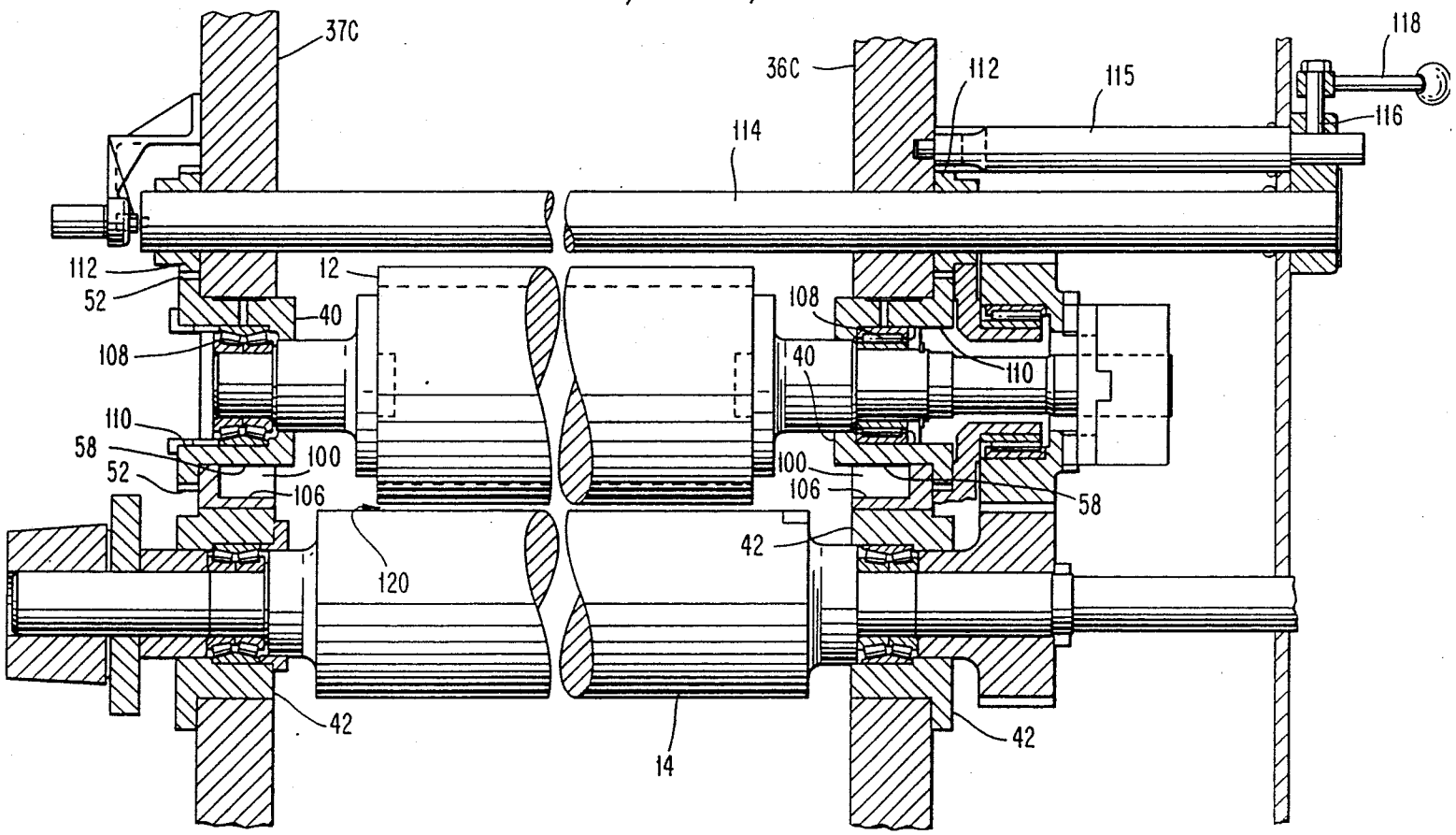
FIG. 5 is a diagrammatic sectional view on the angled line 5—5 of FIG. 6 of a third embodiment of the invention, with some parts omitted for clarity.
Figure 6:
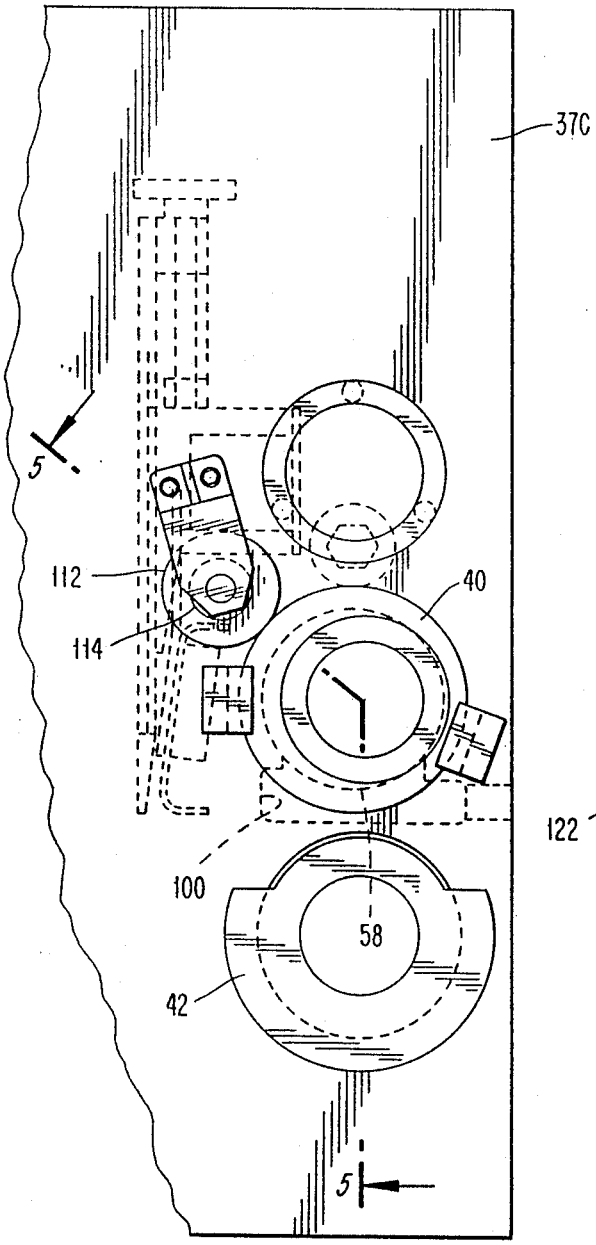
FIG. 6 is an elevational view of the outside of a portion of the opposite side frame to that shown in FIG. 2 of part of the sheet feeding apparatus of FIG. 1, but modified in accordance with the third embodiment of FIG. 5.
Figure 7:
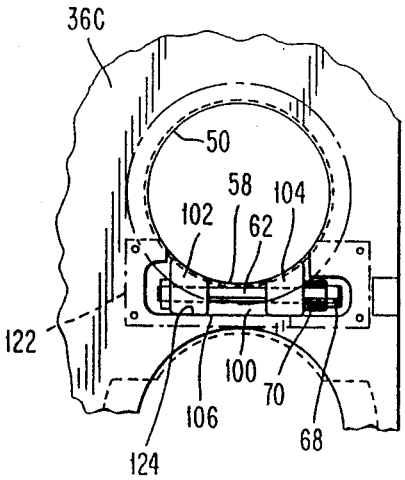
FIG. 7 is a fragmentary view, somewhat similar to FIG. 4, showing a detail of the third embodiment of FIGS. 5 and 6.

FIGS. 5, 6 and 7 illustrate the most preferred embodiment of the invention, while FIG. 2 and FIG. 4 illustrate respectively two other preferred embodiments of the invention.

Figure 1:
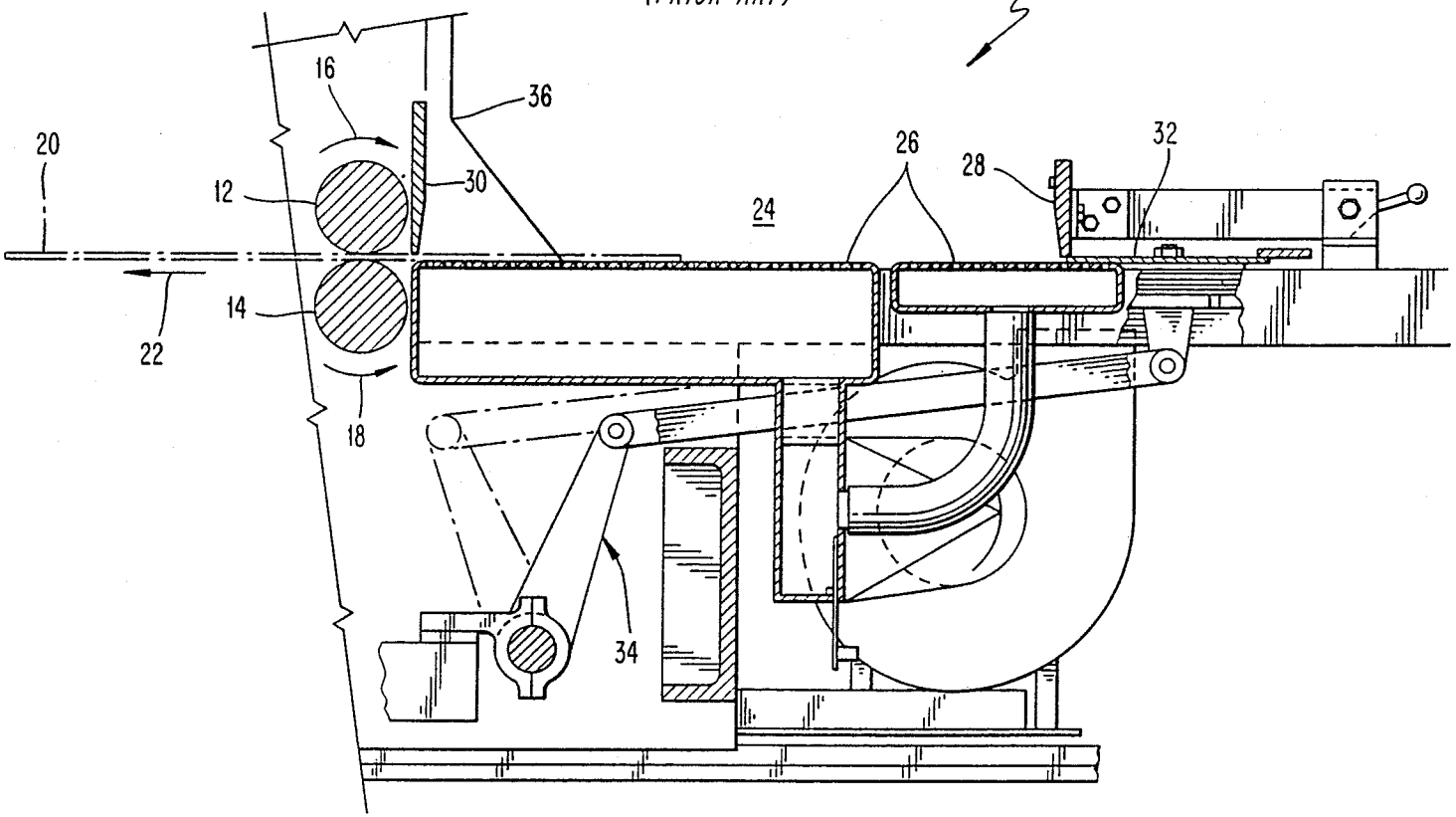
Fig. 1 (PRIOR ART)
FIG. 1 is a side elevational view, partly in section and simplified, of a sheet feeding apparatus of the prior art.

FIG. 1 shows a sheet feeding apparatus of the prior art and to which the present invention can be applied. The present invention is also applicable to any apparatus having an adjustable pair of feed rolls for feeding sheets of paperboard therebetween, particularly sheets of corrugated paperboard as used in the production of container blanks.

In machinery for producing container blanks from sheets of corrugated cardboard, there are usually several pairs of feed rolls for successively progressing the sheets through the machinery at a preselected feed velocity. Such pairs of feed rolls are adjustable to increase or decrease the clearance of the nip between the rolls to accommodate different thickness of sheet stock, and the present invention is applicable to any such pairs of feed rolls. The sheet feeding apparatus 10 of FIG. 1 has one such pair of feed rolls 12, 14 both of which are rotatably driven in the direction of the arrows 16, 18 to feed individual sheets 20 (one such sheet being shown in broken lines) one at a time in the direction of the arrow 22.

In FIG. 1, a stack of sheets (not shown) is placed in a hopper 24 having a bottom 26, an adjustable back wall 28, and a forward wall formed by a gate 30. A kicker bar 32, reciprocated horizontally over part of the bottom 26 by a drive mechanism 34, successively pushes the bottom sheet 20 of the stack below the gate 30 into the nip of the feed rolls 12, 14. The feed rolls 12, 14 grip the sheet 20 and feed it at a controlled speed in the direction of the arrow 22 to further downstream sheet processing machinery, e.g. creasing apparatus, die cut apparatus, and/or printing apparatus. For further details of the sheet feeding apparatus 10 and its manner of operation see Ward, Jr. et al U.S. Pat. No. 3,588,095 the whole disclosure of which is incorporated herein by reference.

The shaft bearings of the upper roll 12 are housed in eccentric bearing housings, the latter being rotatably mounted in the side frames of the apparatus 10. One such side frame 36 is partly shown in FIG. 1. The purpose of the eccentric mounting is to permit movement of the upper roll 12 away from the lower roll 14 to accommodate different thicknesses (caliper) of corrugated paperboard sheets that are passed between the rolls (different thicknesses for separate order runs, the thickness of the sheets in an individual order being substantially the same). The elevation of the upper roll is adjusted relative to the lower roll by rotation of a pinion shaft carrying pinion gears in mesh with gear teeth formed on the eccentric housings. A shaft lock normally locks the pinion shaft.

The bearing housings for the lower roll 14 are fixed to the side frames and support the weight of the lower roll without vertical movement. A problem arises in connection with the upper roll 12; since its eccentric bearing housings must be rotated periodically in the holes in the side frames, there is necessarily a clearance between the outer circumference of the housings and the holes in the frames. When a sheet is not passing between the rolls, the weight of the upper roll 12 causes the eccentric housings to rest on the bottom of the holes in the side frames. The distance between the peripheries of the rolls is set slightly less than the thickness of the sheet so that the sheet is gripped and advanced by the rolls (the sheet is slightly crushed by this action—in the order of 0.003 to 0.004 inch). Although the sheet is resilient, it is still stiff enough to force the upper roll upward, which drives the eccentric housings against the tops of the holes in the side frames as the sheet enters the nip between the rolls.

On a nominal size press of 50 by 113 inches, which feeds sheets up to about 45 inches long (in the longitudinal machine direction) by 111 inches wide (across the width of the press), the sheets may be fed at a rate of up to 240 per minute. Thus, the leading edges of the sheets entering the nip will force the upper roll upwards 240 times each minute. In addition, such sheets normally have two cross-corrugator scores spaced at different intervals along the length of the sheet and which extend across the width of the sheet. The spacing between the scores varies in the sheet with different orders depending upon the final size of the corrugated box to be produced. The scores themselves result in a reduced thickness of the sheet along their length. As the scores pass between the feed rolls, they act much like the leading edge of the sheet, forcing the upper roll upwards. Thus, the roll is forced upwards as many as 720 times per minute.

The side frames are usually made of cast iron as are the eccentric housings. This constant pounding or hammering of the housings against the top of the holes in the frames soon beats the holes into an elliptical shape. This results in even more clearance between the housings and the holes which compounds the problem, as more clearance tends to cause the upper roll to bounce. When the roll bounces only a few thousandths of an inch, it loses contact with the sheet passing between the rolls, and this results in non-uniform feeding velocity. Since the sheets are advanced into adjacent timed machine modules, such as printers and die cutters, the loss of register caused by non-uniform feeding velocity is extremely detrimental.

One idea that has been tried with limited success is to put hardened steel bushings in the holes in the frames within which the eccentric housings are mounted. However, there must still be a clearance between the housings and the bushings to permit rotation of the housings for adjustment for sheet thickness. The housings still bounce within the bushings and eventually beat the bushings into an elliptical shape. Thus, the problem remains.

Coating the steel bushings with a layer of hard nickel and with a dry lubricating material, such as polytetrafluorethylene, between the housings and nickel plated bushings has also been tried with little more success than just by using the bushings alone.

The present invention contemplates pre-loading the upper feed roll into an uppermost position with the top periphery of the eccentric housings forced into continuous hard engagement with the holes in the side frames. With the eccentric housings in constant contact in this manner, the holes will not be pounded into an elliptical shape and loss of register will not occur. The eccentric housings can be rotated in this maintained upper position to provide the desired space between the rolls for the amount of crush needed to advance the sheets.

The preferred means for pre-loading the upper roll, that is, pre-loading the eccentric housings into maintained engagement with the tops of the holes in the frames, comprises the use of wedges between the eccentric bearing housings and a fixed surface. Such arrangements are shown in FIGS. 2, 4 and 7 and will be described in greater detail later.

In general, in these embodiments, there are upper and lower holes in the side frames in which the upper eccentric housings and lower bearing housings are seated. Preferably, a part of the frame between these holes is removed to form a cavity extending only part way through each frame. Two wedges are placed in this cavity so that they rest against a side of the eccentric housing. A threaded screw, or other element, is passed through holes in the wedges and captivates them in position. A spring is retained between the head of the screw and one of the wedges. Tightening the screw into the other wedge, or shortening the other element, brings the wedges closer together. Since the lower sides of the wedges bear against a surface fixed relative to the side frame, the upper eccentric housing moves upwards, by the amount of the clearance between that housing and the hole in the frame, to the top of the hole. Thus, with no clearance between the housing and the hole, the housing cannot bounce against the top of the hole and will not beat it into an elliptical shape. The housing is maintained in the up position at all times.

The spring is employed to permit control of the amount of pre-loading of the eccentric housing. By compressing the spring, the amount of pre-loading desired can be attained. It must be remembered that the upper eccentric housing should be capable of being rotated for adjustment. If no spring is used, merely locking the eccentric housing in the up position may very well prevent such rotation; on the other hand, if it is not locked tight enough, the housing will still bounce. The spring permits the upper housing to be pressed against the top of the hole the desired amount.

The preferred amount of pre-loading is twice the weight of the upper roll which, for the size machine referred to above, is about 1000 pounds. If greater than this amount, the eccentric housing will resist rotation for adjustment. If less than about 1½ times the weight of the roll, the roll may be prone to spring downward (because of the presence of the spring) after the leading edge of each sheet passes between the rolls.

FIG. 2 illustrates how the side frame 36, and the mounting of the upper adjustable roller 12 therein, is modified according to one embodiment of the invention. The modified side frame is designated 36A and houses in holes therethrough an eccentric bearing housing 40 and a normal concentric bearing housing 42. The bearing housing 40 is vertically above the bearing housing 42, these housings respectively housing bearings of the upper and lower rolls 12, 14. The lower bearing housing 42 is non-rotatably clamped in the side frame 36A by a keeper plate 44 (shown in broken lines). The upper bearing housing 40 is rotatably mounted in the side frame 36A and has an eccentric bore 46 for housing one of the bearings rotatably supporting the upper roll 12. There is a small clearance between the outer cylindrical periphery 48 of the eccentric housing 40 and the inner cylindrical wall 50 of the hole through the side frame 36A, this clearance being necessary to enable rotation of the eccentric housing 40 in the side frame 36A when adjusting the distance of the upper feed roll 12 from the lower feed roll 14. Outside the side frame 36A, the eccentric housing 40 has a ring of external gear teeth indicated by the broken line 52. A pinion (not shown in FIG. 2—but see FIG. 5) meshes with the teeth 52 for adjustably rotating the eccentric housing 40 and for locking the housing 40 in its adjusted orientation.

Between and communicating with the side frame holes 50, 54 accommodating the bearing housings 40, 42 is a cavity 56 formed partway through, and in the inner side of, the side frame 36A. The upper and lower boundaries of the cavity 56 are formed and closed by arcuate outer surface portions 58, 60 of the upper and lower bearing housings 50, 52. In the cavity 56 is located a screw threaded bolt 62 on which are mounted two oppositely orientated wedges 64, 66. Each wedge 64, 66 has an upper arcuate concave surface which conforms to and contacts the arcuate convex portion 58 of the outer periphery of the upper bearing housing 40. Each wedge 64, 66 also has a lower arcuate concave surface which conforms to and contacts the arcuate portion 60 of the lower bearing housing 42. The head 68 of the bolt 62 is provided with a socket (not shown) for an Allen key. Five pairs of Belleville spring washers 70 are mounted on the bolt 62 and compressed between the bolt head 68 and the wedge 66. The bolt passes freely through a longitudinal bore 72 in the rear wedge 66 and is screwed through a threaded longitudinal bore 74 in the forward wedge 64. A locking nut 76 is tightened against the forward surface of the wedge 64 to lock the threaded portion of the bolt 62 relative to the wedge 64. The bolt head 68 is accessible by removing a screw threaded plug 78 in a threaded bore 80 which extends from the rear of the cavity 56 to the rear vertical edge 82 of the side frame 36A. The bolt 62 is adjusted to compress the spring washers 70 a predetermined amount, to effect a predetermined wedging force of the wedges 64, 66 between the fixed bearing housing 42 and the adjustable eccentric bearing housing 40. This causes the bearing housing 40 to be forced upwards so that the uppermost portion of the eccentric housing 40 is forced against the uppermost portion of the side frame hole 50 at the location 84. This takes up all the clearance or tolerance between the housing 40 and the hole 50, and as this wedging action positively and firmly holds the housing 40 permanently in contact with the hole 50 at location 84, the housing 40 cannot "hammer" upwards each time a new sheet 20 enters the nip between the feed rolls 12, 14. The purpose of the five pairs of Belleville washers 70 is to enable the eccentric housing 40 still to be rotatable in the hole 50, for adjustment of the nip between the rollers 12, 14 without the need for excessive turning force. The bolt 62 is adjusted in tightness to a predetermined torque that accomplishes the above two function, i.e. firm contact at location 84 and rotation of housing 40 without undue force.

Figure 3:
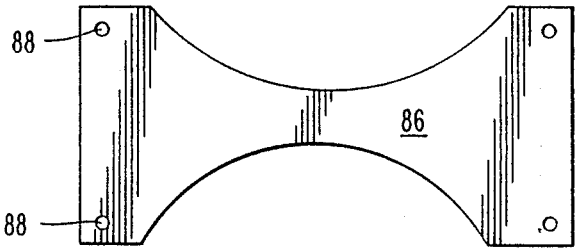
FIG. 3 is an elevational view of a cover removed from the arrangement of FIG. 2.

FIG. 3 shows a cover plate 86 which covers the inwardly facing, open side of the cavity 56. The position of the cover plate 86 when in place is shown in broken lines in FIG. 2. Screws (not shown) pass through holes 88 at the corners of the cover plate 86 and engage in threaded bores 90 (FIG. 2) in the side frame to releasably secure the cover plate in position. The cover plate 86 conceals the wedges 64, 66, and the plug 78 conceals the bolt head 68.

FIG. 4 illustrates a modification of the pre-loading arrangement of FIG. 2 with regard to tightening the wedges 64, 66. Should it be desired or necessary because of roll size to pre-load the upper roll 12 (FIG. 1) more than twice its own weight, and still be able to rotate the eccentric housing 40 (or to lock this housing in its upmost position without the use of springs), the adjusting screw 62 may be replaced by the ram 92 of a pneumatic or hydraulic cylinder 94, such as shown in FIG. 4 accommodated in the side frame 36B. When the ram 92 is drawn towards the cylinder 94 in the direction of the arrow 96, air or hydraulic pressure of sufficient magnitude will lock the eccentric housing 40 hard in the up position, but such pressure may be relieved by an appropriate valve at such time as it is desired to rotate the housing 40. A pair of Belleville spring washers 98 may be located between the wedge 66 and the cylinder 94 to facilitate alignment of the wedge 66 with the wedge 64.

FIGS. 5, 6 and 7 illustrate a third embodiment of the invention, this embodiment being a further modification of the pre-loading arrangement of FIGS. 2 or 4.

FIG. 5 shows in more detail the mounting of the feed rolls 12, 14 in side frames 36C and 37C. Side frames 36C, 37C are similar to side frame 36 in FIG. 1, except that a different shaped cavity 100 for a pair of modified wedges 102, 104 (omitted from FIG. 5—but see FIG. 7) is provided on the inside of each side frame 36C, 37C. Each cavity 100 is modified from the cavity 60 in FIG. 2 insofar as the bottom 106 of cavity 100 is flat, horizontal and spaced above the lower roll bearing housing 42. The upper extremity of each cavity 100 is closed by the lower arcuate surface portion 58 of the respective eccentric, upper bearing housing 40 as in the first embodiment of FIG. 2.

FIG. 5 clearly shows more detail of the upper and lower bearing housings 40, 42, and the roller bearings housed therein and in which end shafts of the rolls 12, 14 are journalled. The bearings 108 for the upper roll 12 can be seen mounted in eccentric bores 110 of the upper bearing housings 40. These housings 40 each have an outer flange carrying the ring of gear teeth 52 which mesh with pinions 112 on pinion shaft 114. Rotation of the pinion shaft 114 via an input shaft 115 rotates the eccentric housings 40 to adjust the nip 120 between the rolls 12, 14. After such adjustment, the shaft 114 is locked against rotation by a shaft lock 116, on the input shaft 115, operated by a handle 118.

FIG. 6 shows in side elevation the position of the pinion shaft 114 and pinion 112 to the upper and lower bearing housings 40, 42. In FIG. 6 the rollers 12, 14, their end shafts and other parts are omitted for clarity. The modified cavity 100 is shown in broken lines.

FIG. 7 is a view somewhat similar to FIG. 2 but of a portion of the inside of the side frame 36C. The bearing housings 40, 42 have been omitted for simplicity. The pair of wedges 102, 104 are flat on their lower sides 124, but are convexly curved on their upper sides the same as the upper sides of the wedges 64, 66 of FIGS. 2 and 4. The wedges 102, 104 are drawn together by the bolt 62, Belleville washers 70, and bolt head 68 as previously described in relation to FIG. 2. As before, the upper convex side of each wedge 102, 104 engages and presses upwards the eccentric bearing housing (omitted from FIG. 7) rotatably mounted in the side frame hole 50. However, the lower flat side 124 of each wedge 102, 104 is supported on and presses against the flat bottom 106 of the cavity 100, this flat bottom 106 being formed by the metal of the side frames 36C, 37C. In this embodiment, which otherwise operates and is adjusted the same as the embodiment of FIG. 2, no loading is placed on the lower bearing housings 42 in creating the predetermined pre-loading upwardly of the eccentric housings 40. The innermost side of the cavity 100 (and wedges 102, 104) is covered by a removal cover 122 of modified shape shown in broken lines.

It will be appreciated that any of the foregoing embodiments can be employed with any pair of adjustable feed rolls, in any machine or machine section, where the upper roll is mounted in vertically adjustable bearings for adjusting the distance between the rolls. The preloading of the upper roll mountings upwards, to take up any upper tolerances, eliminates any hammering of the upper roll mountings in the side frames or other supports.

The above described embodiments, of course, are not to be construed as limiting the breadth of the present invention. Modifications, and other alternative constructions, will be apparent which are within the spirit and scope of the invention as defined in the appended claims.

What is claimed is:

1. Apparatus, comprising:

a pair of rotatable feed rolls;

one of said rolls being eccentrically mounted in rotatably adjustable bearing housings, adjustable rotation of said bearing housings moving said one feed roll towards or away from the other feed roll;

means for pre-loading said bearing housings in a direction away from said other feed roll; and said preloading means comprising wedges acting upon said bearing housings and resilient means for resiliently loading said wedges against said bearing housings.

2. The apparatus of claim 1, wherein said one feed roll is above said other feed roll.

3. The apparatus of claim 2, wherein said bearing housings are mounted in side frames supporting said feed rolls, and said pre-loading means is mounted in cavities in said side frames.

4. The apparatus of claim 3, wherein said cavities are disposed below but in communication with said bearing housings.

5. The apparatus of claim 4, wherein each of said cavities has a floor, and said wedges are operative between the floors of said cavities and said bearing housings.

6. The apparatus of claim 4, wherein the other of said feed rolls is mounted in non-adjustable bearing housings, said cavities are also in communication with said non-adjustable bearing housings, and said wedges are operative between said adjustable bearing housings and said non-adjustable bearing housings.

7. The apparatus of claim 1 wherein each bearing housing is acted upon by two said wedges mounted on a bolt.

8. The apparatus of claim 7, wherein said bolt has means for rotating said bolt to draw said two wedges towards each other.

9. Apparatus, comprising:

a pair of rotatable feed rolls;

one of said rolls being eccentrically mounted in rotatably adjustable bearing housings, adjustable rotation of said bearing housings moving said one feed roll towards or away from the other feed roll;

means for pre-loading said bearing housings in a direction away from said other feed roll;

said pre-loading means comprising wedges acting upon said bearing housings; and said pre-loading means including a fluid cylinder for moving at least one of said wedges.

10. Apparatus, comprising:

a pair of rotatable feed rolls;

one of said rolls being eccentrically mounted in rotatably adjustable bearing housings, adjustable rotation of said bearing housings moving said one feed roll towards or away from the other feed roll;

means for pre-loading said bearing housings in a direction away from said other feed roll; and said pre-loading means comprising a fluid cylinder.

11. Apparatus, comprising:

a pair of rotatable feed rolls;

one of said rolls being eccentrically mounted in rotatably adjustable bearing housings, adjustable rotation of said bearing housings moving said one feed roll towards or away from the other feed roll;

means for pre-loading said bearing housings in a direction away from said other feed roll;

said pre-loading means comprising wedges acting upon said bearing housings; and said wedges having two opposite sides oppositely concavely curved.

12. Apparatus, comprising:

a pair of rotatable feed rolls;

one of said rolls being eccentrically mounted in rotatably adjustable bearing housings, adjustable rotation of said bearing housings moving said one feed roll towards or away from the other feed roll;

means for pre-loading said bearing housings in a direction away from said other feed roll;

said pre-loading means comprising wedges acting upon said bearing housings; and said wedges each having a concave side and an opposite flat side.

13. Apparatus for handling sheets of paperboard and the like, comprising:

two spaced apart side frames;

an upper feed roll rotatably mounted in bearing housings supported in said side frames;

a lower feed roll rotatably mounted in said side frames and disposed below said upper feed roll;

means for adjustably moving said bearing housings relative to said side frames for moving said upper feed roll away from and towards, respectively, said lower feed roll to accommodate different thicknesses of sheets to be handled by the apparatus and fed between said feed rolls;

means for pre-loading said bearing housings upwardly in said side frames away from said lower feed roll after said bearing housings have been adjusted by said adjustably moving means;

said pre-loading means comprising two wedges mounted on a bolt, the bolt being screwed into one of the wedges and the bolt slidably passing through the other wedge; and a spring acting between said bolt and said other wedge to urge said other wedge towards said one wedge.

14. The apparatus of claim 13, wherein said spring comprises a plurality of Belleville washers mounted on said bolt.

15. Apparatus for handling sheets of paperboard and the like, comprising:

two spaced apart side frames;

an upper feed roll rotatably mounted in bearing housings supported in said side frames;

a lower feed roll rotatably mounted in said side frames and disposed below said upper feed roll;

means for adjustably moving said bearing housings relative to said side frames for moving said upper feed roll away from and towards, respectively, said lower feed roll to accommodate different thicknesses of sheets to be handled by the apparatus and fed between said feed rolls;

means for pre-loading said bearing housings upwardly in said side frames away from said lower feed roll after said bearing housings have been adjusted by said adjustably moving means; and said pre-loading means comprising wedges resiliently loaded against said bearing housings.

16. Apparatus for processing sheets of corrugated paperboard in the production of container blanks, comprising:

a pair of feed rolls between which the sheets are fed while passing through the apparatus;

a pair of side frames in which the feed rolls are rotatably mounted one above the other;

the upper of said feed rolls being journalled in bearings which are mounted eccentrically in bearing housings rotatable in holes in said side frames;

means for adjustably rotating said bearing housings in said holes to move said upper feed roll respectively away from and towards the lower of said feed rolls;

a cavity in each side frame disposed below and communicating with the respective bearing housing;

a pair of wedges disposed in each cavity and acting upon the respective bearing housing;

means for moving said pair of wedges towards each other to force the respective bearing housing upwards in the respective side frame hole; and said moving means comprising a fluid cylinder having an elongate ram extending therefrom, said wedges being mounted on said ram.

* * * * *